US007513259B2

(12) United States Patent
Kimata et al.

(10) Patent No.: US 7,513,259 B2
(45) Date of Patent: Apr. 7, 2009

(54) HAIR CURLING APPARATUS

(76) Inventors: Toshihiro Kimata, 1-15-6, Kotsubo, Zushi-shi (JP) 249-0008; Makoto Ohtake, 1-2-1-201, Takahama, Mihama-ku, Chiba-shi (JP) 261-0003

( * ) Notice: Subject to any disclaimer, the term of this patent is extended or adjusted under 35 U.S.C. 154(b) by 509 days.

(21) Appl. No.: 11/136,104

(22) Filed: May 24, 2005

(65) Prior Publication Data

US 2005/0268933 A1 Dec. 8, 2005

(30) Foreign Application Priority Data

Jun. 3, 2004 (JP) ..... 2004-165842
Apr. 21, 2005 (JP) ..... 2005-123152

(51) Int. Cl.
*A45D 2/00* (2006.01)

(52) U.S. Cl. ..... 132/245

(58) Field of Classification Search ..... 132/236–242, 132/243, 245, 250, 251; 242/279, 315, 432, 242/573.5, 125.1–125.3, 118.32, 118.7; D28/37; 112/279

See application file for complete search history.

(56) References Cited

U.S. PATENT DOCUMENTS 1,709,918 A * 4/1929 Santurello ..... 132/266
2,785,690 A * 3/1957 Trabish ..... 132/238
3,759,271 A * 9/1973 Caruso ..... 132/233
4,222,398 A * 9/1980 Fromman ..... 132/238
5,711,324 A * 1/1998 Johnson et al. ..... 132/252

* cited by examiner

*Primary Examiner*—Robyn Doan
*Assistant Examiner*—Rachel A Running
(74) *Attorney, Agent, or Firm*—Jordan and Hamburg LLP

(57) ABSTRACT

A curling apparatus employed for curling hair comprises a shaft which hair is coiled round; a stopper having a substantially C-shaped section, the stopper being disposed outside the shaft detachably; and a threaded engagement device which is disposed outside the stopper, and yet threaded to the shaft, the curling apparatus being configured in such a manner that turning/moving the threaded engagement device with the hair on a root side fastened to the shaft and a tip of the hair guided to the side of the threaded engagement device allows the hair to be spirally coiled round the shaft.

8 Claims, 9 Drawing Sheets

FIG.13
(PriorArt)
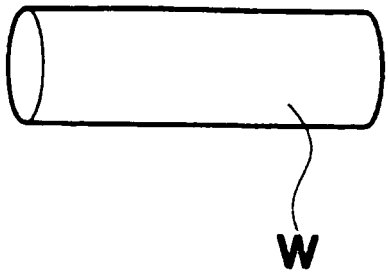

HAIR CURLING APPARATUS

BACKGROUND OF THE INVENTION

The present invention relates to, for example, a technology of curling or waving of hair on a person's head.

A curling apparatus for curling hair on a person's head is on sale commercially. This curling apparatus (curler) is comprised of a cylindrically shaped body W made of, for example, plastic, as shown in FIG. 12, and a method of using it is described as follows. At first, a tip of the hair is pressed against the surface of the cylindrically shaped body W, the hair is coiled round the cylindrically shaped body W from the tip side thereof. And, after coiling the hair up to the root side thereof, the hair is fastened with a stopper so that the coiling of the hair is not released. Thereafter, its situation is maintained for a time being. Doing so allows the hair to maintain the curled shape, which follows a shape of the cylindrically shaped body W, even after the stopper is released.

When such a curler W as shown in FIG. 12 is employed, thereby to curl the hair, in most cases, the hair is not curled beautifully.

In addition, a curling operation is troublesome.

Accordingly, a task to be solved by the present invention is to provide a technology that is capable of beautifully curling the hair, and yet has excellent operationality.

The present inventor has earnestly made investigation into the reason why the hair is not curled beautifully with the conventional curler W and why it does not operate as desired, and as a result of the investigation, has found out that the followings are the reason why the hair is not curled beautifully.

At first, with the conventional curler W, in coiling the hair round the curler W, the hair is coiled round the curler from the tip side thereof. That is, a tip of the hair is placed on the surface of the cylindrically shaped body (curler) W to coil the hair toward the root side of the hair. Thereupon, all the hair cannot be equal in length. Some are long, and some are short. Accordingly, even though a tip of one bundle of the hair is placed on the surface of the cylindrically shaped body W, the hair, which is short, is not coiled beautifully. Some are coiled just like they are folded. That is, the hair is coiled toward the direction contrary to a flow of the hair, so the hair is not coiled beautifully.

It has been recognized that because the hair is coiled toward the direction contrary to a flow thereof, its coiling operation is burdensome.

In addition, it seems that the hair is further coiled upon the hair coiled on the surface of the cylindrically shaped body W. That is, the hair is coiled, in a word, doubly or three-fold. For this, the hair coiled on the upper layer side receives less curling force because the hair existing on its lower layer side acts as a cushion. Accordingly, when the coiling of the hair is released from the cylindrically shaped body W, it seems that the hair on the upper layer side (the hair on the root side) has not been curled. That is, it has been recognized that the hair is not curled beautifully in the entirety thereof.

And, the inventor has come to the conclusion that coiling the hair toward the tip side from the middle or the root side thereof without coiling the hair from the tip side thereof as well as coiling it spirally would solve the problems.

The present invention has been accomplished based upon such knowledge.

SUMMARY OF THE INVENTION

The object of the present invention is accomplished with a method of curling hair that is characterized in that the hair is spirally coiled from the root side or the middle to the tip side thereof and its status is maintained.

In particular, the task is solved with a method of curling hair that is characterized in that toward the lower side from the upper side of a shaft disposed along the vertical direction, the hair is spirally coiled round the shaft, and its status is maintained.

In the above-mentioned present invention, push pressure is preferably applied to the hair coiled spirally for the shaft toward the tip side from the root side or the middle thereof.

Moreover, the task is solved with a curling apparatus to be employed in the method of curling hair.

Moreover, the task is solved with a curling apparatus to be employed for curling hair that is characterized in comprising: a shaft, which hair is coiled round; a stopper having a substantially C-shaped section, the stopper being disposed outside the shaft detachably; and a threaded engagement device which is disposed outside the stopper and yet is threaded to the shaft, wherein the curling apparatus is configured in such a manner that turning/moving the threaded engagement device with the hair on its root side fastened to the shaft and a tip of the hair guided to the side of the threaded engagement device allows the hair to be spirally coiled round the shaft.

Moreover, the task is solved with a curling apparatus to be employed for curling hair that is characterized in including: a shaft, which hair is coiled round, a stopper having a substantially C-shaped section; the stopper being disposed outside the shaft detachably; a spacer disposed detachably between the shaft and the substantially-C-shaped stopper; and a threaded engagement device, which is disposed outside the stopper, and yet is threaded to the shaft, wherein the curling apparatus is configured in such a manner that turning/moving the threaded engagement device with the hair on its root side fastened to the shaft and a tip of the hair guided to the side of the threaded engagement device allows the hair to be spirally coiled round the spacer.

The shaft and the threaded engagement device of the curling apparatus of the above-mentioned present invention are preferably configured in such a manner that disengagement of its threaded engagement allows them to be detached from each other. The reason is as follows. After the hair was coiled round the shaft, the threaded engagement device can be dispensed with. And, in a case where the curling apparatus is hanging on to the hair, if the threaded engagement device is removed, the curling apparatus becomes lighter, thereby alleviating an unpleasant feeling.

Moreover, when the spacer to be detachably disposed between the shaft and the substantially-C-shaped stopper is provided, the shaft and the threaded engagement device can be dispensed with after the hair was coiled round the spacer. In addition, if the shaft and the threaded engagement device are removed, the curling apparatus is light because it is only the spacer and the stopper that are hanging on the hair. Accordingly, an unpleasant feeling is reduced extremely Moreover, the shaft of the present invention is preferably provided with a position regulator for regulating a position of the stopper. The reason is as follows. The stopper acts so that the coiling of the hair coiled round the shaft is not released. Thereupon, the hair is spirally coiled relative to the shaft. At this time, the threaded engagement device lowers in the axial direction of the shaft. As accompanied by this lowering, when the stopper moves, it loses its function. Accordingly, it is preferable to provide the position regulator for allowing the stopper fixed relative to the shaft. Additionally, the position regulator may be configured of a flange provided in the lower end of the shaft. It may be merely a convexity.

Moreover, it is preferable that the shaft of the present invention has a threaded bore provided from its lower side, and yet the threaded engagement device has a threaded shaft which is threaded to the threaded bore, and a cylindrically shaped body sized so that the substantially C shaped stopper is disposed in its inside. Doing so allows the weight of the shaft to be reduced even though a diameter of the shaft is enlarged.

In addition, provision of the threaded bore allows holes punched on the peripheral surface of the shaft to have serial communication with the threaded bore. Accordingly, a flow path of air can be configured well. In addition, by configuring such a flow path of air, the flow path of air can be utilized for drying the hair coiled round the shaft.

Moreover, a guide for guiding the hair is preferably provided in the cylindrically shaped body. That is, provision of the guide allows the hair to be guided well to the shaft.

Further, it is preferable that the substantially C-shaped stopper has a protruding piece provided in its one end, and in particular, the protruding piece is positioned on the side of the cylindrically shaped body, thereby preventing the guided hair to be caught between the substantially C-shaped stopper and the cylindrically shaped body.

In addition, the curling apparatus of the present invention further preferably includes a roller mechanism. Further including the roller mechanism allows a roller of the roller mechanism to apply pressure to the hair spirally coiled round the shaft. In addition, when the pressure is applied to the spirally coiled hair, the force acts in a direction in which a cuticle of the hair, which currently opens, will be closed. As a result, the hair is curled more beautifully. In particular, it is extremely effective in a case of employing a permanent wave liquid.

In the present invention, the hair is coiled from the root side or the middle toward the tip side thereof. Accordingly, the hair can be coiled far more easily and yet more beautifully as compared with the case where the hair is coiled from the tip side toward the root side thereof. For example, the hair can be coiled easily and beautifully even though the length of the hair is short in some cases and is long in some cases. In particularly, the hair is coiled in a shape that follows a flow of the hair without acting against the hair, whereby the hair can be coiled easily and beautifully. For this, a curl given to the hair is also beautiful.

And yet, the hair is not coiled in a shape of being stacked such that the hair is coiled doubly or three-folded as is the case with the conventional way. That is, the hair is coiled spirally. Accordingly, the hair is less stacked at the moment that it was coiled. Thereby, the curling force is strong, and the entirety of the hair is curled beautifully.

Further, to coil the hair spirally means that the hair is coiled from the upper side toward the lower side of the shaft disposed in a substantially vertical direction because the hair extends downward from the top. Accordingly, operation is excellent as compared with the case where the hair is coiled round the curler positioned horizontally, which is the conventional case, In particular, taking the case where the hair is coiled by oneself into consideration, operation of the present invention is excellent.

BRIEF DESCRIPTION OF THE DRAWING

FIG. 13 is an oblique view illustrating the conventional curling apparatus.

DESCRIPTION OF THE EMBODIMENTS

Figure 1:
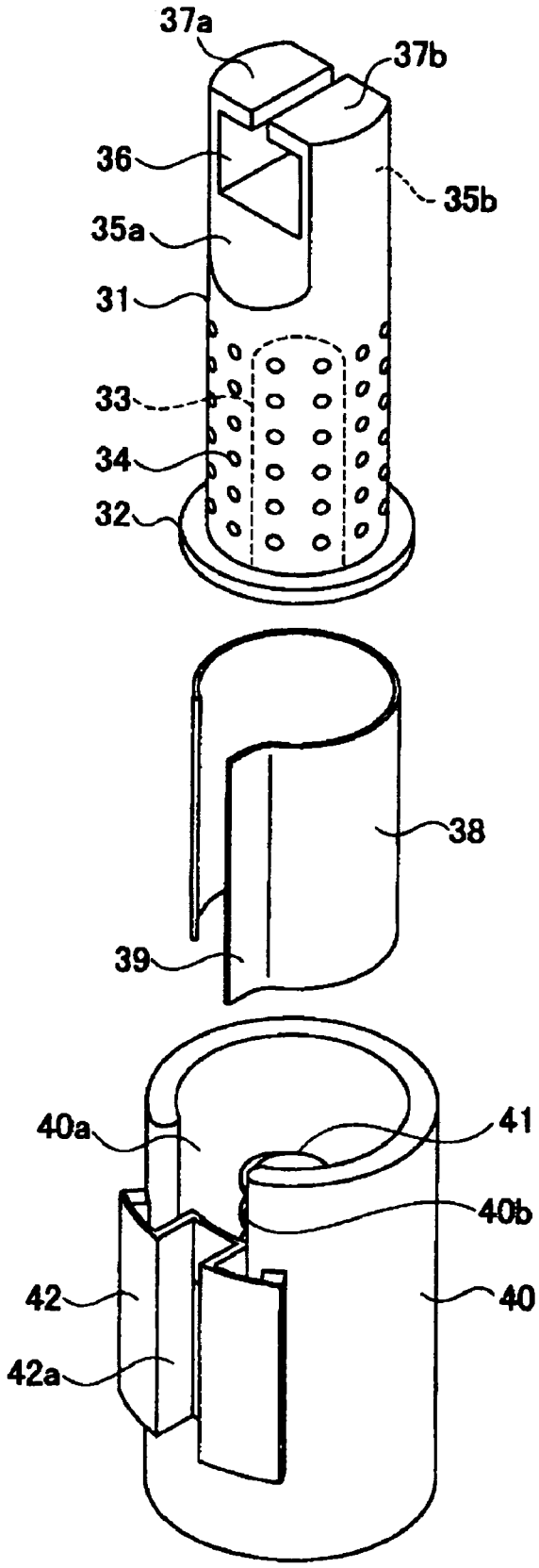
FIG. 1 is an oblique view illustrating a curling apparatus of a first embodiment in a unassembled state.
Figure 2:
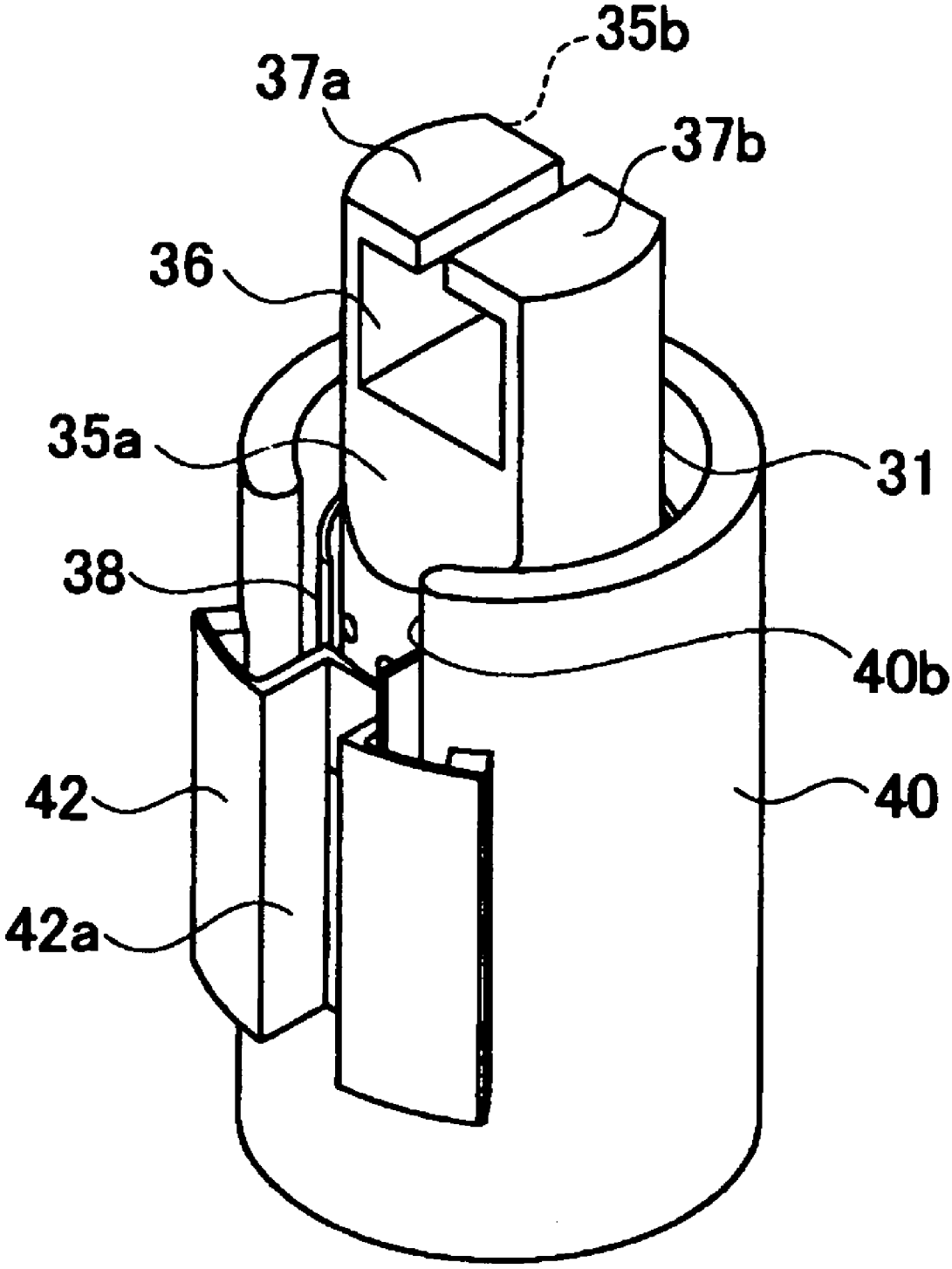
FIG. 2 is an oblique view illustrating an assembled state of the first embodiment.
Figure 3:
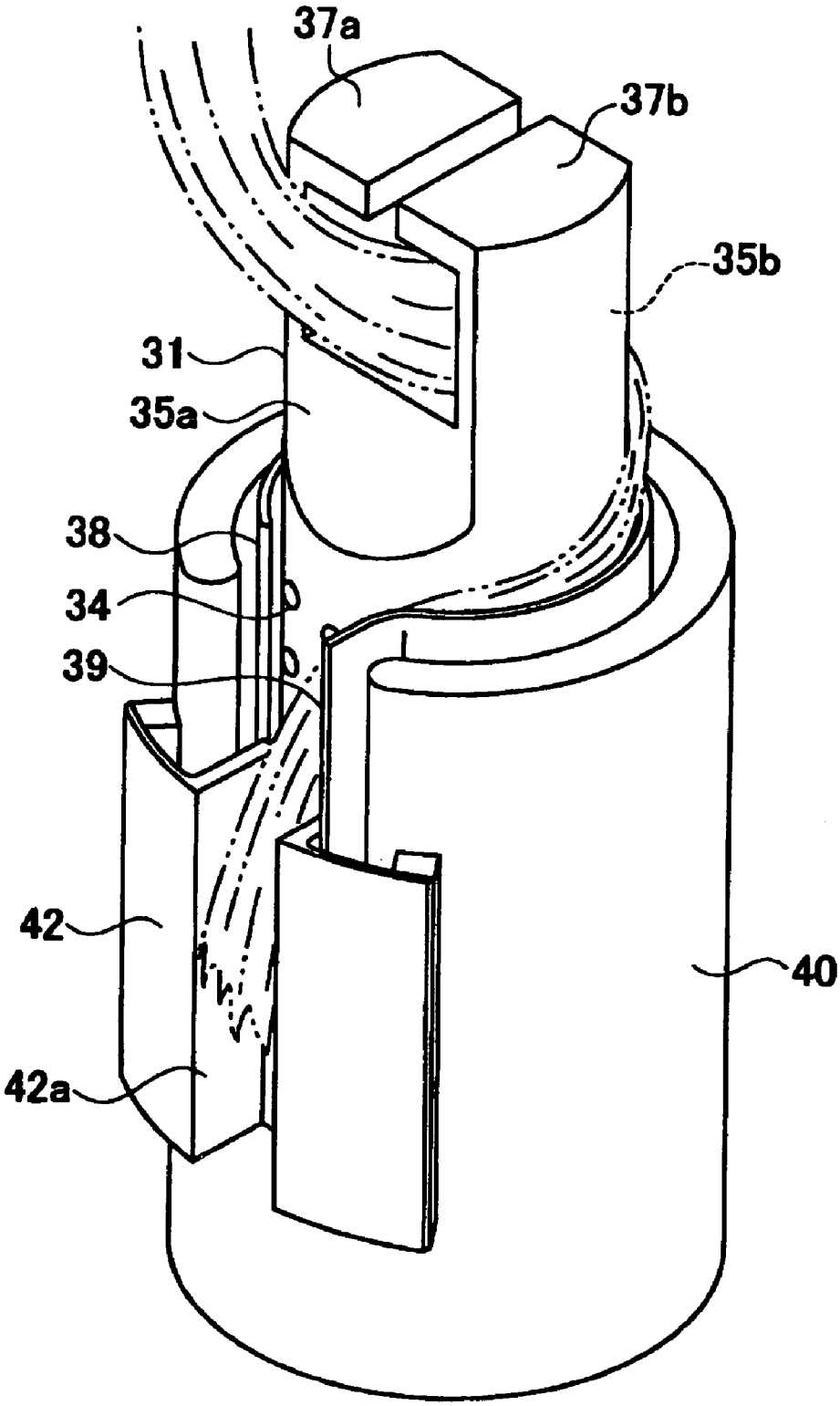
FIG. 3 is an oblique view illustrating the curling apparatus of the first embodiment under operation.
Figure 4:
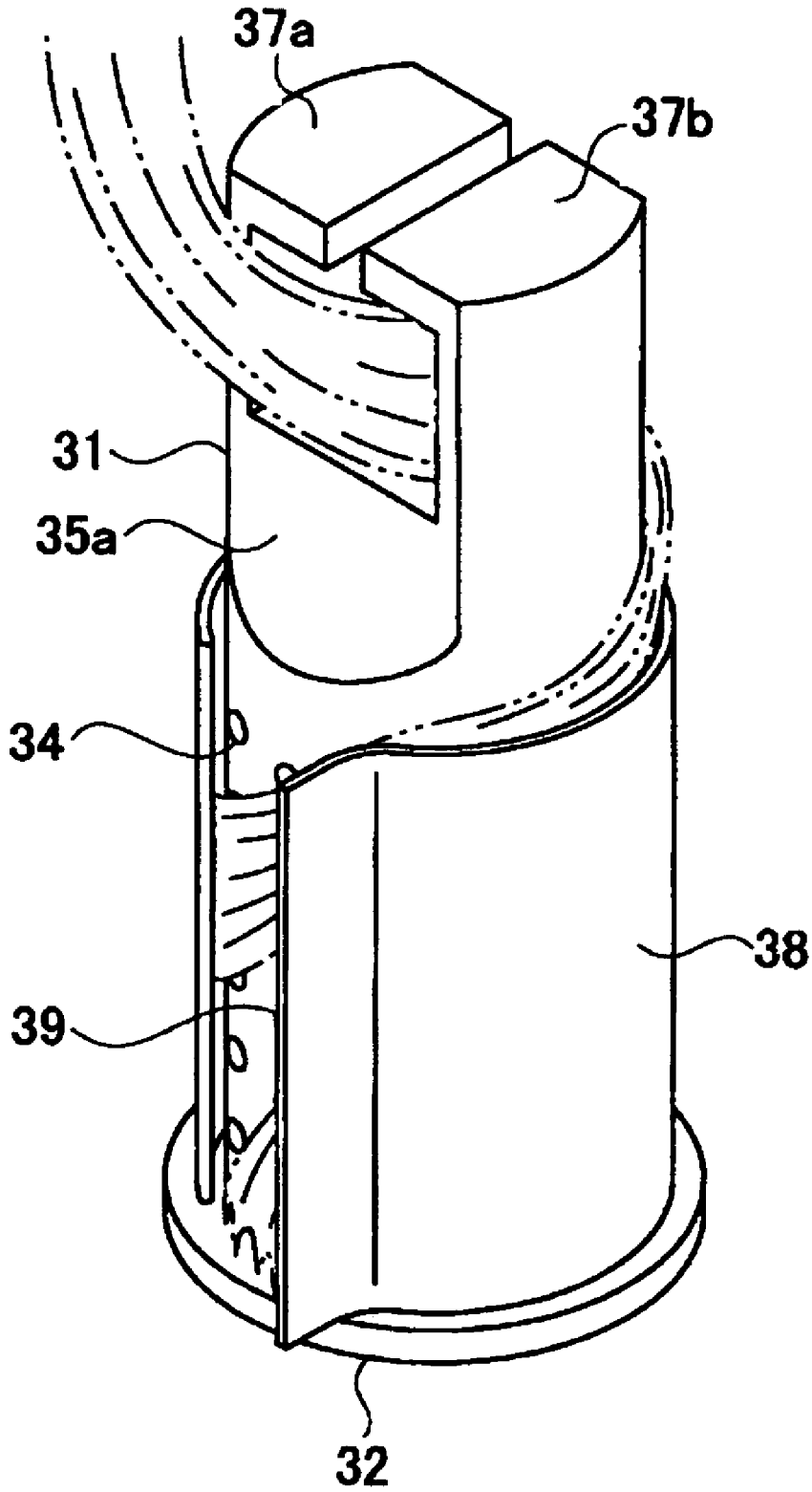
FIG. 4 is an oblique view illustrating a state after coiling with the curling apparatus of the first embodiment.

FIG. 1 to FIG. 4 illustrate the curling apparatus relating to a first embodiment of the present invention, FIG. 1 is an oblique view illustrating a disassembled state thereof, FIG. 2 is an oblique view illustrating an assembly state thereof, FIG. 3 is an oblique view illustrating the state where coiling the hair is underway, and FIG. 4 is an oblique view illustrating the state after coiling.

In each figure, 31 is a shaft. The shaft 31 is a shaft formed in a predetermined shape, which is made of, for example, plastic or light metal. In particular, it is a shaft made of plastic having a small specific gravity (The specific gravity is 2 or less. Preferably it is 1 or something like it.) The peripheral surface of the shaft 31 is circular (a circle having a radius of r1), and a flange 32 provided in the lower end of the shaft 31. A threaded bore 33 provided upward from the lower end surface of the shaft 31. A hole 34 provided on the peripheral surface of the shaft 31. The hole 34 and the threaded bores 33 communicate with each other. Flat surfaces 35*a* and 35*b* are on a side of an upper portion of the shaft 31. In addition, the flat surfaces 35*a* and 35*b* are configured so that they can be held by applying fingers hereto. A concavity 36 is formed on an upper end of the shaft 31. Doors 37*a* and 37*b* are openable and closable and of a spring-tension type provided inward from both walls of the concavity 36.

A stopper 38 has a substantially C-shaped section (circular arc of a circle having a radius of r2). The stopper 38 is made of heat resisting resin. Its thickness is 1 mm or something like it. Accordingly, the substantially C-shaped stopper 38 has an appropriately-sprung tension. A protruding piece 39 is provided in one end of the stopper 38. The stopper 38 is positioned outside the shaft 31. The hair exits between the stopper 38 and the shaft 31 in a use state of the curling apparatus of the present invention. In addition, the stopper 38 pushes the hair spirally coiled in the surroundings of the shaft 31 against the surface of the shaft 31. This allows the coiling of the spirally coiled hair not to be released. From a viewpoint of such a purpose, (radius r2>radius r1) is defined. Moreover, the value of r2-r1 is a few. For example, it is in a level of, so as to speak, 1 mm or less. Additionally, the stopper 38 may have an appropriate hole formed.

A cylindrically shaped body 40 has an opening 40*a* formed on its side. A radius r3 on an inner side of the cylindrically shaped body 40 is a dimension larger than the radius r2 of the stopper 38 by 1 to 5 mm or something like it. However, (an inner diameter of the cylindrically shaped body 40)≈(an outer diameter of the flange 32 of the shaft 31). A threaded shaft 41 is provided in the inner side of the cylindrically shaped body 40. In addition, when the shaft 31 is inserted into the cylindrically shaped body 40 through an upper-side opening thereof, the threaded bore 33 of the shaft 31 can be threaded to the threaded shaft 41. Turning the shaft 31 relatively to disengage the threaded engagement enables the shaft 31 and the cylindrically shaped body 40 to be separated. A guide member 42 is provided in a side opening 40*a* of the cylindrically shaped body 40. This guide member 42 has a groove-shaped concavity 42*a* in a vertical direction. In addition, suitable knurling for preventing skidding is formed on the outer peripheral surface of the cylindrically shaped body 40.

In addition, each part of the shaft 31, the stopper 38 and the cylindrically shaped body 40 configured as mentioned above is assembled as shown in FIG. 2. That is, the threaded bore 33 of the shaft 31 is threaded to the threaded shaft 41 of the cylindrically shaped body 40. That is, the shaft 31 is housed in the interior of the cylindrically shaped body 40. In addition, the stopper 38 is housed outside the shaft 31, and yet inside the cylindrically shaped body 40. At this time, the protruding piece 39 of the stopper 38 is housed so as to shroud a wall surface 40*b* of the opening 40*a* of the cylindrically shaped body 40.

Next, a method of using the curling apparatus configured as mentioned above will be explained.

At first, a proper quantity of the bundled hair on the root side thereof is arranged in the concavity 36 of the shaft 31, and a tip of its hair is arranged in the groove-shaped concavity 42*a* of the guide member 42. Next, the cylindrically shaped body 40 is turned. This causes the cylindrically shaped body 40 to lower. Accordingly, the hair is spirally coiled round the shaft 31. Besides, the hair is spirally coiled from the root side thereof. Additionally, the protruding piece 39, which extends from the stopper 38, exists between the outer surface of the stopper 38 and the inner surface of the cylindrically shaped body 40, so the hair is guided between the stopper 38 and the shaft 31. Additionally, the protruding piece 39 fits into the opening 40*a* of the cylindrically shaped body 40. Accordingly, the stopper 38 and the cylindrically shaped body 40 are united as one body. Thus, when the cylindrically shaped body 40 is turned, accompanying by this, the stopper 38 also is turned together with it.

As the cylindrically shaped body 40 is turned, the shaft 31 finally comes off the cylindrically shaped body 40. In addition, also in this state, i.e. in a state shown in FIG. 4, the substantially C-shaped stopper 38 has a spring contact with the hair coiled spirally round the shaft 31. Accordingly, there is no possibility that the coiling of the spirally coiled hair is released.

Thus, for a time being, keeping this state allows the hair to be curled.

At this time, if the hair is in a state of being wet, air is sent through the threaded bore 33. This causes air to be discharged from the hole 34. Accordingly, this discharged air accelerates drying of the hair.

Additionally, as not shown in FIG. 1 to FIG. 4, in some case, a substantially cylindrical shaped spacer is provided. This spacer can be inserted detachably in the surroundings of the shaft 31. Moreover, it can be detachably inserted inside the stopper 38. Moreover, the spacer is designed so that the wall thickness thereof is thin for the purpose of reducing its weight. In addition, the spacer may have an appropriate hole formed, if necessary.

In addition, when the curling apparatus having this spacer inserted outside the shaft 31 and yet inside the stopper 38 is employed, the hair is spirally coiled round the spacer. Accordingly, after the hair was coiled, even though the shaft 31 and the cylindrically shaped body 40 are removed, the hair is maintained in a spiral state by the spacer and the stopper 38. Thus, the shaft 31 and the cylindrically shaped body 40 can be removed, which reduces an uncomfortable feeling at the moment that they hang on the hair.

Additionally, a spacer that is not of cylindrical shape is acceptable, and a spacer having a mode of being coiled round the shaft 31 is also acceptable. For example, a sheet is acceptable. However, it is preferable that the sheet has rigidity allowing the cylindrical shape to be maintained.

Figure 5:
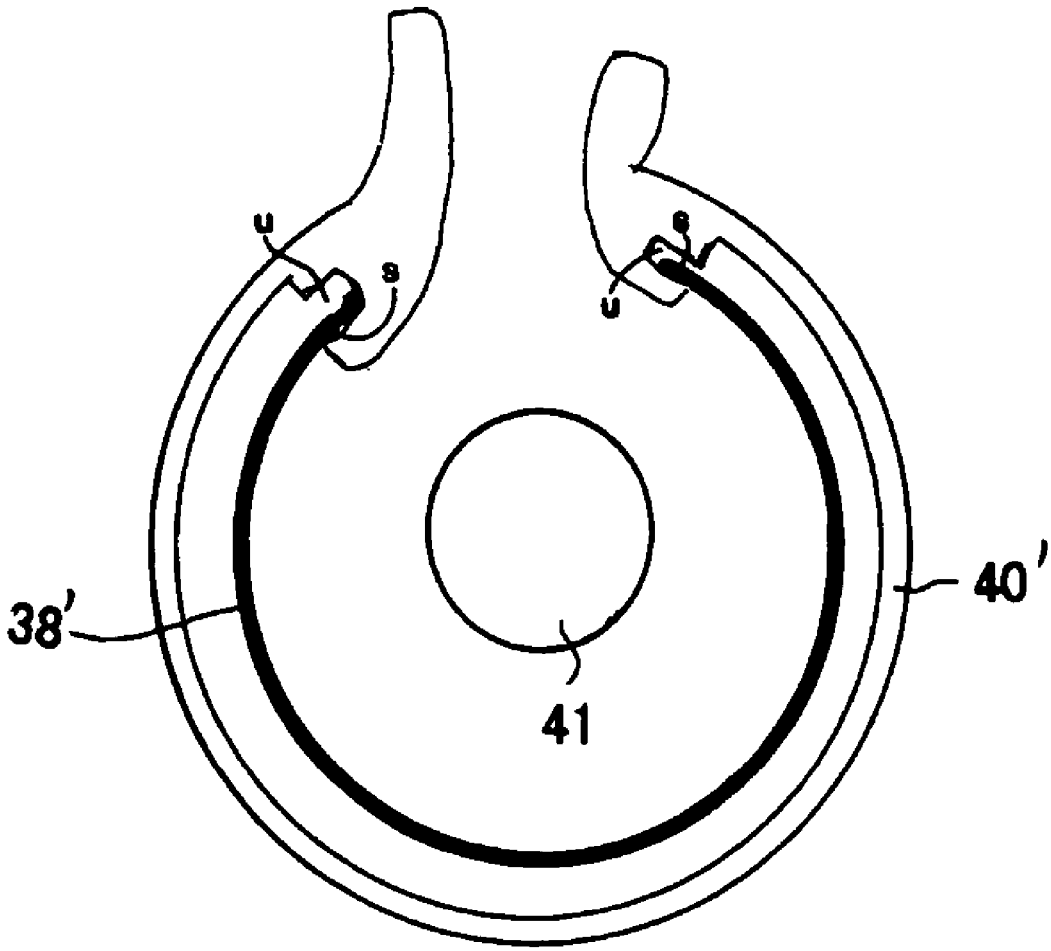
FIG. 5 is a schematic plan of a modification example of the curling apparatus of the first embodiment.

In addition, a stopper 38' having no protruding piece 39 can be considered instead of the above-mentioned stopper 38, as shown in FIG. 5. That is, the stopper 38' may be a stopper having a C-shaped section. However, in such a case, a groove-shaped concavity for allowing an end rib of the stopper 38' having a C-shape section to fit inside the cylindrically shaped body 40' is necessitated. That is, provision of groove-shaped concavities u and u, which allow end ribs s and s of the C-shaped stopper 38' to fit into its inner wall, inside the cylindrical shaped body 40' makes it possible to employ the stopper 38' having no protruding piece.

Figure 6:
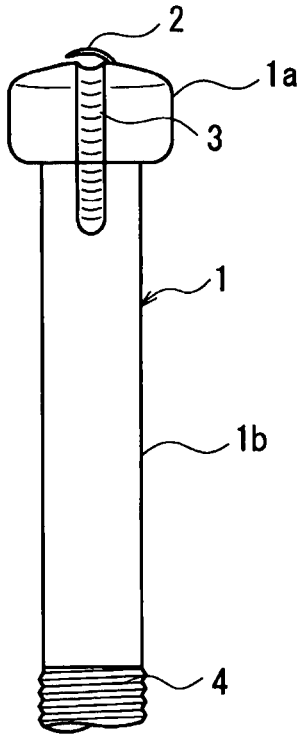
FIG. 6 is an oblique view illustrating a shaft of the curling apparatus of a second embodiment of the present invention.
Figure 7:
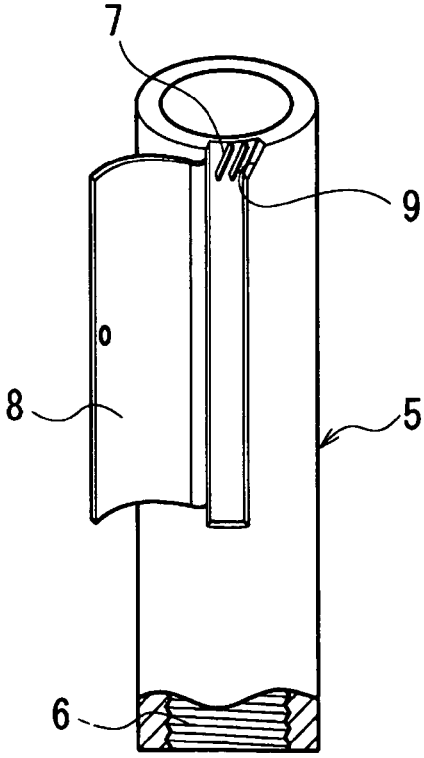
FIG. 7 is an oblique view illustrating a cylindrically shaped body of the curling apparatus of the second embodiment.
Figure 8:
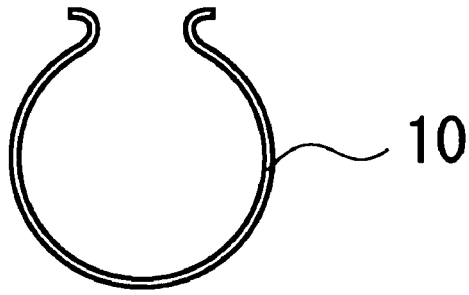
FIG. 8 is a plan illustrating a stopper of the curling apparatus of the second embodiment.
Figure 9:
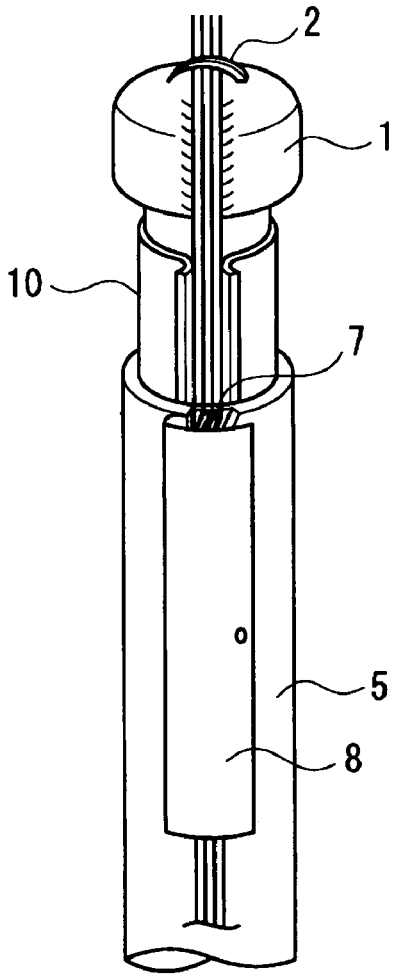
FIG. 9 is an oblique view illustrating an assembly state of the curling apparatus of the second embodiment.

FIG. 6 to FIG. 9 illustrate the curling apparatus relating to a second embodiment of the present invention, FIG. 6 is an oblique view of the shaft, FIG. 7 is an oblique view of the cylindrical shaped body, FIG. 8 is a plan of a stopper 10, and FIG. 9 is a view for explaining a use state.

In each figure, a shaft 1 is shown. This shaft 1 is a cylindrically shaped shaft round which the hair is to be coiled spirally. The upper portion (top or head) of the shaft 1 is closed. The shaft 1 may be a shaft having a columnar shape. However, the shaft 1 is to hang on to the hair, so it preferably weighs light. Accordingly, the cylindrically shaped one is preferable. The shaft 1 is made of raw material, similar to that of the case of the first embodiment. 2, and has a spring hooking piece 2 provided in a head of the shaft 1. This spring hooking piece hook 2 grips the hair. Accordingly, the shaft 1 is enabled to hang on to the hair. A guide groove 3 is provided downward from the head of the shaft 1. The hair hooked by the spring hooking piece 2 is guided by this guide groove 3. A thread 4 is formed on a peripheral surface of a lower portion of the shaft 1. Additionally, as not shown in the figure, the shaft 1 has a heating mechanism integrally installed. In addition, the shaft 1 is heated to an appropriate temperature by this heat mechanism, which makes it easy to curl (wave) the coiled hair. In addition, a head 1*a* and a body 1*b* are structured so that they can be removed. That is, if necessary, for example, only the head 1*a* can be removed after operation.

A cylindrically shaped body 5 is to be disposed outside the shaft 1. The cylindrically shaped body 5 also is made of light material similarly to the shaft 1. In particular, it is formed of resin. A threaded groove 6 is formed in an inner surface of the cylindrically shaped body 5. That is, the threaded groove 4 in the outer periphery of the shaft 1 and the threaded groove 6 in the inner periphery of the cylindrically shaped body 5 are configured so that they can thread to each other. Accordingly, when the cylindrically shaped body 5 is turned in a predetermined direction, the cylindrically shaped body 5 moves toward the lower side of the shaft 1 at a constant pitch while turning round the shaft 1. A groove 7 is (groove-shaped concavity) formed on the upper side of the cylindrically shaped body 5. A cover 8 is openable and closable so as to shroud the groove-shaped concavity 7. Additionally, the groove-shaped concavity 7 has teeth of a comb 9 for putting the arranged hair in order provided therein.

A stopper 10 has a substantially C-shaped section, for example, a substantially Ω-shaped stopper. The stopper 10 is made of plastic.

Next, a method of using the curling apparatus configured as mentioned above will be explained.

At first, the cylindrically shaped body 5 is disposed in the surroundings of the shaft 1. In addition, the hair is hooked on the shaft 1 by the spring hooking piece 2. This allows the shaft 1—the cylindrically shaped body 5 to hang on to the hair. Next, the cover 8 is opened, the hair on the tip side is positioned in the groove-shaped concavity 7 of the cylindrically shaped body 5, and thereafter the cover 8 is closed. Thereafter, the cylindrically shaped body 5 is turned round the shaft 1. Doing so causes the hair also to turn round the shaft 1 as the cylindrically shaped body 5 is turned/moved because the hair is hooked on the cylindrically shaped body 5. And yet, the cylindrically shaped body 5 moves toward the lower side of the shaft 1 as the cylindrically shaped body 5 is turned/moved. Accordingly, the hair is spirally coiled round the shaft 1. In addition, at the time point that the length of the spirally coiled hair reached a desired length, turning/moving of the cylindrically shaped body 5 is stopped. Doing so allows the hair to keep the state of having been spirally coiled because the stopper 10 pushes the hair. After a predetermined time has passed in this state, the hair becomes curl-shaped. Moreover, the curling situation, which is beautiful, is obtained.

Figure 10:
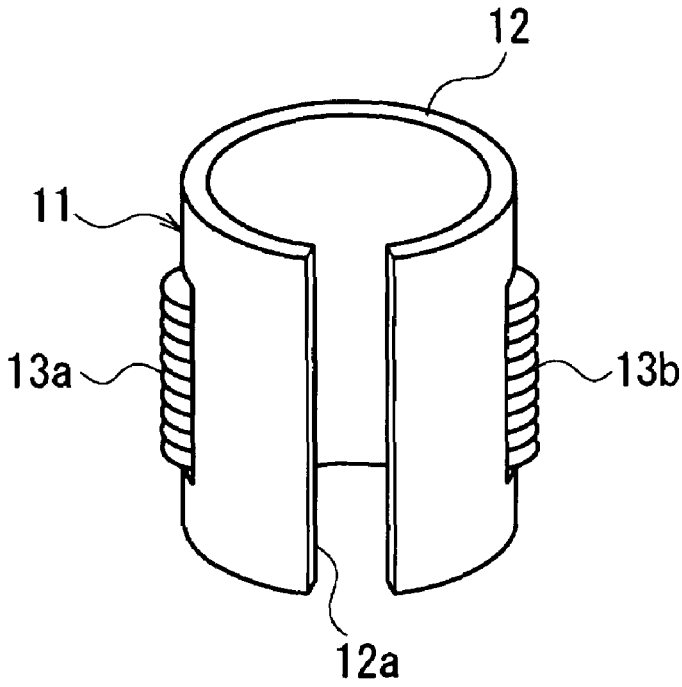
FIG. 10 is an oblique view illustrating a roller body of the curling apparatus of a third embodiment.
Figure 11:
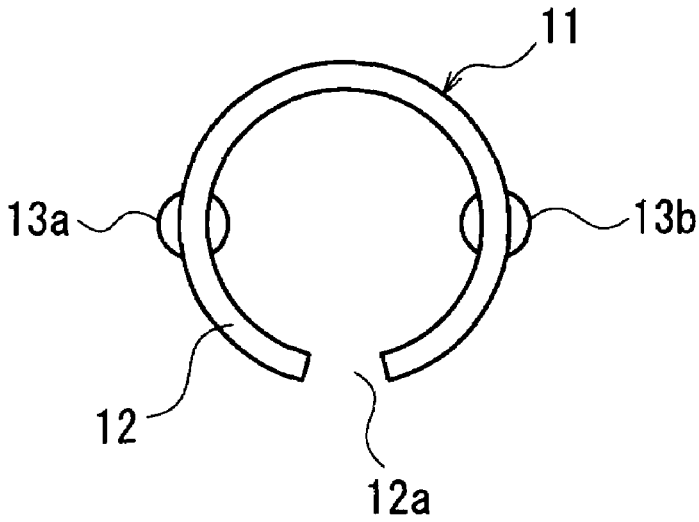
FIG. 11 is a plan illustrating a roller body of the curling apparatus of the third embodiment.
Figure 12:
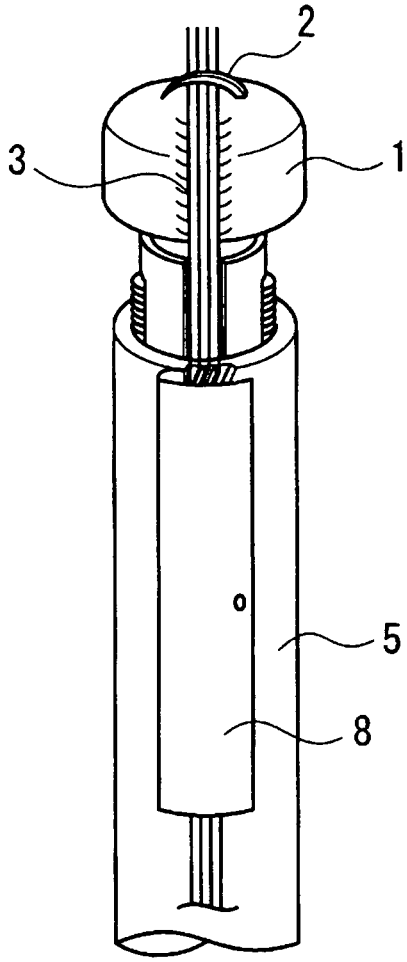
FIG. 12 is an oblique view illustrating an assembly state of the curling apparatus of the third embodiment.

FIG. 10 to FIG. 12 illustrate part of the curling apparatus relating to a third embodiment of the present invention, FIG. 10 and FIG. 11 are an oblique view of the roller body, and a plan thereof, respectively, and FIG. 12 is a view for explaining the use state.

As to this embodiment, the shaft and the cylindrically shaped body are similar to that of the embodiments, so the details explanation will be omitted.

In this embodiment, a roller body 11 of FIG. 10 is disposed for the shaft 1, as shown in FIG. 12. This roller body 11 is configured by mounting a roller 13*a* on a ring-shaped body 12 having a slit 12*a* formed and providing a roller 13*b* so as to face the roller 13*a*. Additionally, as not shown in the figure, these rollers 13*a* and 13*b*, which have a driving mechanism provided, is configured so that the rollers 13*a* and 13*b* are turned by switching on. In addition, as not shown in the figure, the rollers 13*a* and 13*b* have a heating mechanism integrally installed, and the rollers 13*a* and 13*b* are heated to an appropriate temperature by this heating mechanism, so the coiled hair is in a state of being easily curled (waved).

Next, a method of using the curling apparatus configured as mentioned above will be explained.

The operation is performed similarly to that of the embodiments up to the step of stopping the turning/moving of the cylindrically shaped body 5. Thereafter, or during the operation, the rollers 13*a* and 13*b* are turned by switching a switch of the roller body 11 on, and while turning them, the rollers 13*a* and 13*b* are caused to have a pressure contact with the hair spirally coiled and yet processed with the permanent wave liquid. After a predetermined time has passed in this state, the hair becomes curl-shaped. In addition, its curling situation is beautiful. In particular, the force from the rollers 13*a* and 13*b* acts in a direction in which a cuticle of the hair, which currently opens, will be closed, so the hair is curled beautifully all the more.

What is claimed is:

1. A curling apparatus to be employed for curling hair comprising:

a shaft which hair is coiled round;

a stopper having a substantially C-shaped section, said stopper being disposed outside said shaft detachably; and a threaded engagement device which is disposed outside said stopper, and yet thread-engages said shaft, said curling apparatus being configured in such a manner that turning/moving said threaded engagement device with said hair on a root side fastened to said shaft and a tip of said hair guided to a side of said threaded engagement device allows said hair to be spirally coiled round said shaft.

2. The curling apparatus as claimed in claim 1, wherein said shaft and said threaded engagement device are configured in such a manner that disengagement of its threaded engagement allows them to be detached from each other.

3. The curling apparatus as claimed in claim 1, wherein said shaft has a position regulator for regulating a position of said stopper.

4. The curling apparatus as claimed in claim 1, wherein said shaft has a threaded bore provided from its lower side, and wherein:

said threaded engagement device has a threaded shaft, which thread-engages said threaded bore, and a cylindrically shaped body sized so that said substantially C-shaped stopper is arranged inside it.

5. The curling apparatus as claimed in claim 4, wherein said shaft has holes provided in a peripheral surface and these holes have serial communication with said threaded bore.

6. The curling apparatus as claimed in claim 4, wherein said cylindrically shaped body has a guide for said hair.

7. The curling apparatus as claimed in claim 4, wherein said substantially C-shaped stopper has a protruding piece in one end, and said protruding piece is positioned on a side of said cylindrically shapedbody, thereby preventing said hair to be caught between said substantially C-shaped stopper and said cylindrically shaped body.

8. The curling apparatus as claimed in claim 1, wherein the curling apparatus further comprises a roller mechanism, and said roller mechanism allows pressure to be applied to the hair coiled spirally round said shaft.

* * * * *